US005772205A

United States Patent [19]

Coldebella et al.

[11] Patent Number: 5,772,205

[45] Date of Patent: Jun. 30, 1998

[54] SYSTEM TO DETECT INOPERATIVE SWITCHES IN AN AMUSEMENT DEVICE

[76] Inventors: Mark J. Coldebella, 1303 Laguna Ct., Palatine, Ill. 60067; William Pfutzenreuter, 4125 N. Highland Ave., Arlington Heights, Ill. 60004; Greg Topel, 1471 Winslowe Dr. #303, Palantine, Ill. 60067

[21] Appl. No.: 549,060

[22] Filed: Oct. 27, 1995

[51] Int. Cl.[6] ..... A63F 9/24

[52] U.S. Cl. ..... 273/121 A; 327/72

[58] Field of Search ..... 273/121 A, 129 V, 273/371; 463/30, 36, 37, 3; 381/58, 59, 60; 360/25, 26, 31; 327/3, 7, 72, 68

[56] References Cited

U.S. PATENT DOCUMENTS 4,384,716 5/1983 Powers ..... 273/129 V 4,467,372 8/1984 Juodenas ..... 360/31

4,908,868 3/1990 McTaggart ..... 381/59

*Primary Examiner*—George Manuel

*Attorney, Agent, or Firm*—Gary Jarosik; Mark R. Galis

[57] ABSTRACT

A system for determining switch condition in an amusement device having at least one triggering switch is provided. The system comprises a first circuit for generating a first reference electrical signal, a second circuit linked to the at least one triggering switch for generating a first condition electrical signal, and a comparing circuit connected to the first circuit and the second circuit for comparing the first condition electrical signal to the first reference electrical signal and for generating an output electrical signal indicative of said switch condition based upon the comparison. Specifically, the output electrical signal will indicate if the switch is open, if the switch is closed, if the switch is electrically connected (wiring intact), or if the switch is electrically disconnected (wiring broken).

14 Claims, 1 Drawing Sheet

SYSTEM TO DETECT INOPERATIVE SWITCHES IN AN AMUSEMENT DEVICE

BACKGROUND OF THE INVENTION

This invention relates generally to coin operated amusement devices and, more particularly, relates to pinball machines of the type including a computer control system responsive to player inputs typically in the form of switch closures caused by hitting targets.

Amusement devices are constructed to withstand severe operating conditions as they are often abused by players and are located in environments which reduce components functional lives while receiving little or no regular maintenance. When equipment failures do occur, they are frequently associated with playfield features which the game player must strike with the pinball in order to complete the game. If these devices become inoperative it prevents the player from meeting all of the objectives of the game and, therefore, quickly reduces the incentive for players to patronize the game until the problem is repaired.

In an attempt to correct this problem a system is employed in which a microprocessor monitors operation of the amusement device. The microprocessor assumes inoperability of a switch if the switch has not been activated after a statistically significant number of game plays. Specifically, for each switch to be monitored there is reserved in memory a byte to store the state of each switch which is initialized to a predetermined value. Each time a new ball is played the state byte for the switches are decremented and should the state byte reach zero, the switch is considered to be inoperative. If before the state byte reaches zero a valid closure of the switch occurs, the state byte is reset to the predetermined value. Such a system is disclosed in U.S. Pat. No. 4,763,256 to DeMar, issued Aug. 9, 1988, and assigned to Williams Electronics Games, Inc.

While this system has been effective, there remains the possibility that a switch will be designated as faulty when in-fact the switch remains functional resulting in unnecessary repair and shutdown of the machine. Therefore, a need remains for a switch sensing circuit which can automatically detect with precision if a specific switch has factually become disconnected.

As a result of this existing need, it is an object of the present invention to provide a system for reliably detecting if a switch will be prevented from operating during normal play conditions.

It is a further object of the present invention to minimize the hardware and firmware needed to perform the switch evaluation process in contrast to the specialized counting algorithms used in the prior art.

SUMMARY OF THE INVENTION

In accordance with the present invention, a system for determining switch condition in an amusement device having at least one triggering switch is provided. The system comprises a first circuit for generating a first reference electrical signal, a second circuit linked to the at least one triggering switch for generating a first condition electrical signal, and a comparing circuit connected to the first circuit and the second circuit for comparing the first condition electrical signal to the first reference electrical signal and for generating an output electrical signal indicative of said switch condition based upon the comparison.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used in amusement devices it will be described hereinafter in the context of switch detect circuit for a coin operated pinball machine as the preferred embodiment thereof.

Figure 1:
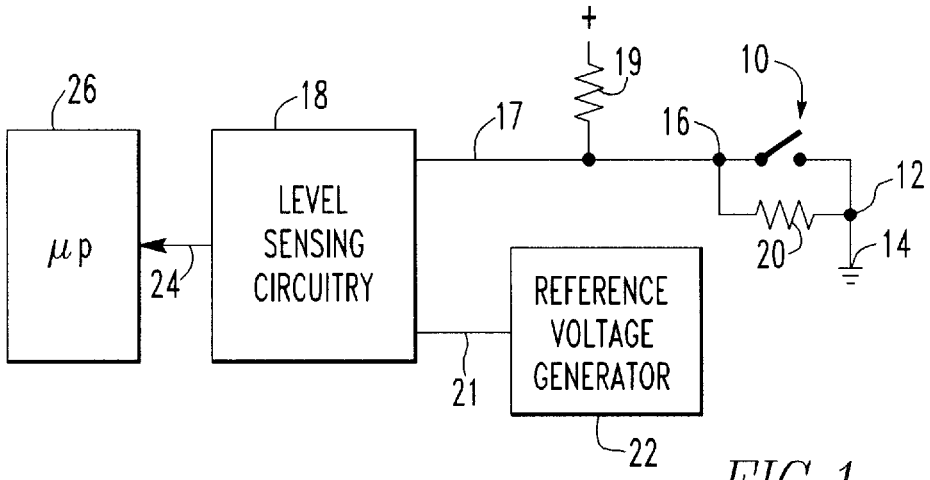
FIG. 1 is a block diagram of the switch sensing circuit which is the subject of the present invention.
Figure 2:
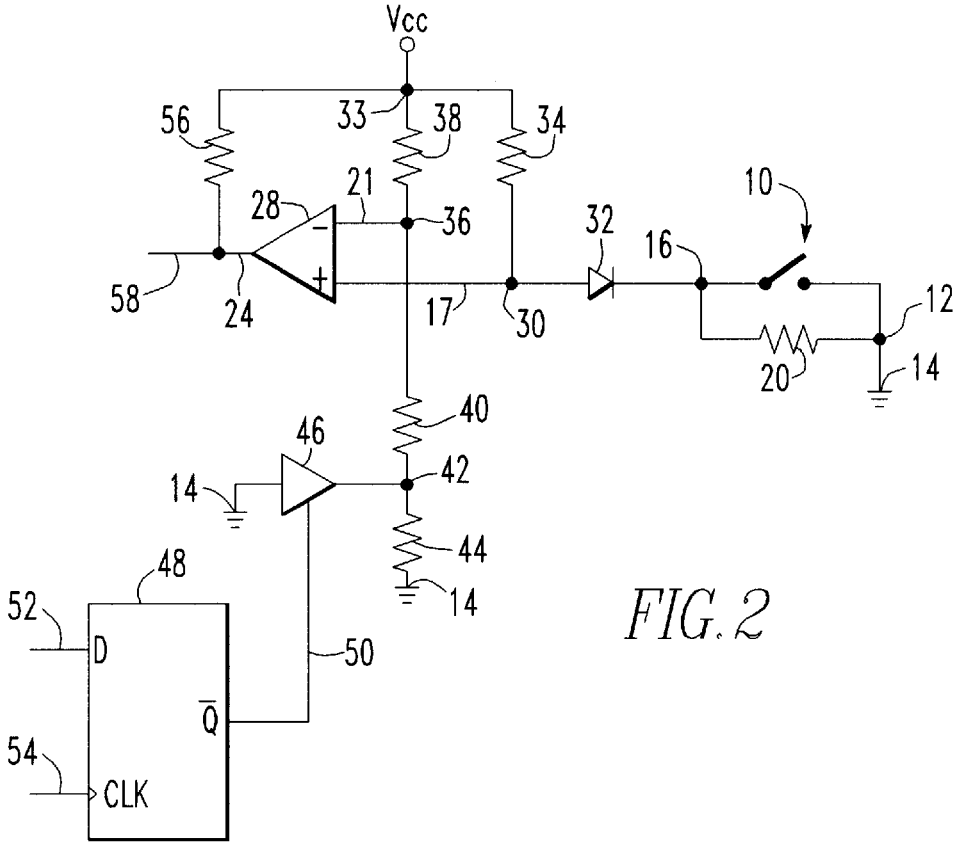
FIG. 2 is a schematic diagram of the switch sensing circuit which is the subject of the present invention.

Referring now to FIGS. 1 and 2, wherein like reference numerals refer to like elements, there is shown in FIG. 1 a block diagram of an embodiment of the sensing circuitry which is the subject of the present disclosure. As shown, a switch 10, representing a pinball target or the like, is connected with one lead tied at node 12 to ground 14 and the other lead, at node 16, connected to line 17 which serves as input to level sensing circuitry 18. Further connected to line 17 is a pull-up resistor 19. Connected in parallel across the switch 10, between the nodes 12,16, is a resistor 20. The level sensing circuitry 18 is further supplied with a reference voltage input along line 21 from reference voltage generating circuitry 22. An output line 24 from the level sensing circuitry 18 supplies a signal to a microprocessor 26. The level sensing circuitry is used to determine the difference between the two voltage signals supplied for the purpose of evaluating the switch condition as will be discussed hereinafter.

Illustrated in FIG. 2 is a schematic diagram of the circuits disclosed in FIG. 1. Specifically, the level sensing circuitry and the reference voltage generator are comprised of an operational amplifier or op-amp 28 having the (+) terminal tied to the switch input line 17, the (−) terminal tied to the reference voltage input line 21, and the output terminal tied to output line 24. Specifically, switch input line 17 is connected to a node 30 where a diode 32, used for circuit protection purposes, connects the line 17 from node 30 to node 16. The diode is positioned such that its anode is connected to node 30 while its cathode is connected to node 16. Node 30 is also connected to Vcc at node 33 through a resistor 34.

The reference voltage line 21 is connected to node 36 which is tied to Vcc through resistor 38. Also connected to node 36 is a resistor 40 having its other terminal tied to node 42. Node 42 is tied to ground 14 through a resistor 44 and is also tied to the output of bus buffer 46. Bus buffer 46 is preferably a 741s126 having its data input tied to ground 14. The control input of bus buffer 46 is tied to the not output gate of a D-type flip flop 48 by line 50. Flip flop 48 is preferably a 741s74. The data input terminal of the flip flop 48 is tied to the data bus by line 52 and the clock input terminal is tied by line 54 to decode circuitry (not shown) which is turn associated with the microprocessor. Finally, feedback from the output of op-amp 28 is provided by connecting a resistor 56 between node 33 and node 58 to which the output line 24 is also connected.

In operation, during normal play conditions, the reference voltage input 21 is set to a predetermined voltage level, Vrefn, by reference voltage generating circuitry 22. The level sensing circuitry 18 then compares the voltage on the switch input line 17 to Vrefn. If the level sensing circuitry 18 determines that the voltage on the switch input line 17 is greater than Vrefn an open switch 10 has been detected and the appropriate flags are set by the microprocessor which is connected to the output of the circuitry 18. An open switch designation typically defines that the player has not yet activated the appropriate target during play. If the level sensing circuitry 18 determines that the voltage on the switch input line 17 is less than Vrefn a closed switch 10 has been detected and the appropriate flags are again set by the microprocessor. A closed switch designation typically defines that the player has activated the appropriate target during play.

In test mode, a diagnostic routine which may be performed prior to play, during play, or at the request of a technician, the same circuitry used to determine switch conditions during normal play is utilized to evaluate the integrity of the switch circuity. To perform the diagnostic procedure, the reference voltage input line 21 is set to another predetermined voltage level, Vreft, by the voltage reference circuitry 22. Vreft is preferably at a higher level that Vrefn. The level sensing circuitry 18 again compares the voltage on the switch input line 17 to Vreft. If the level sensing circuitry 18 determines that the voltage on switch input line 17 is below Vreft than a pass switch has been detected and the appropriate flags are set by the microprocessor to signify that the switch circuitry is intact. If, however, the level sensing circuitry determines that the voltage on switch input line 17 is greater than Vreft than a fail switch has been detected and the appropriate flags are set by the microprocessor to signify that the switch is in a fault condition. The fault condition occurs if the switch 10 is disconnected either from ground 14 or switch input line 17. It is important to determine if the wiring leading from node 12 to ground 14 or from node 16 to the input of switch sensing circuitry 18 is broken as switch 10 will be unable to operate during normal play under such conditions.

In the preferred embodiment Vcc is set to +5 Volts while resistors 20, 34,38, and 40 are all 2.2 K ohms, feedback resistor 56 is 10 K ohms, and resistor 44 is 3.3 K ohms.

In the normal mode Vrefn at node 36 will be set to approximately 2.5 Volts as node 42 is supplied a ground signal through bus buffer 46. Specifically, during the normal mode, the flip-flop 48 is controlled by the microprocessor to set up an enabling signal on line 50 which in turn activates buffer 46 causing the ground signal to be supplied to node 42. In the test mode the output of buffer 46 is directed to float in a high-impedance state by the control signal supplied from flip-flop 48 along line 50 causing Vreft at node 36 to be set to approximately 3.6 Volts as node 42 will be tied to ground through resistor 44.

The voltage at node 30, which is compared to the voltage at node 36, is seen to depend upon the condition of switch 10 and the wires connecting the switch 10 to both ground 14 and node 30. When the switch 10 is closed, so as to bypass resistor 20, and when the wires are intact the voltage level at node 30 is for all practical purposes grounded. When the switch 10 is open, bringing resistor 20 into the circuit, and when the wiring is intact the voltage level at node 30 is a few millivolts over 2.5 Volts. If, however, the wiring is broken the voltage at node 30 is seen to float at approximately Vcc. It is these voltages that are compared with Vrefn and Vreft in op-amp 28 where the output signal, which depends upon the voltages supplied to the input terminals, is supplied to microprocessor for interpretation. In other words, the microprocessor will determine switch condition based upon the output signal voltage level.

As discussed, the information concerning switch conditions is transferred to the microprocessor as a voltage signal along line 24 where the microprocessor may set various flags in memory locations in a manner known to those skilled in the art. During play, these memory locations may be polled to gain information concerning the status of a particular switch such that game play may be altered to accommodate various switch conditions. Furthermore, these memory locations would be made accessible to a technician whereby the condition of particular switches may be polled for evaluation and repair purposes.

It should be apparent from the preceding description that this invention has among other advantages, the advantage of providing a simplified test circuit for evaluating switch conditions in a pinball machine.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. An amusement game comprising:

a playfield;

an electronically connected triggering switch mounted on said playfield;

first circuit for generating a predetermined reference electrical signal;

a second circuit linked to said triggering switch for generating a predetermined condition electrical signal; and a comparing circuit connected to said first circuit and said second circuit for comparing said predetermined condition electrical signal to said predetermined reference electrical signal and for generating an output electrical signal indicative of said switch condition based upon said comparison.

2. The system as recited in claim 1, wherein said predetermined reference electrical signal and predetermined condition electrical signal are both voltage levels.

3. The system as recited in claim 2, wherein said second circuit comprises a resistor connected in parallel with said triggering switch and wherein said predetermined condition electrical signal is approximately equal to the voltage drop across said resistor.

4. The system as recited in claim 2, wherein said comparing circuit comprises an operation amplifier.

5. The system as recited in claim 4, wherein said second circuit comprises a first resistor connected in parallel with said triggering switch and linked to said operational amplifier such that a change in said switch condition causes a change in voltage across said first resistor.

6. The system as recited in claim 5, wherein said first circuit comprises a second resistor linked to a third resistor with said third resistor being linked to said operational amplifier and further comprising a switch for disconnecting said second resistor from said third resistor whereby a change in connection of said second resistor to said third resistor causes a change in voltage across said third resistor.

7. The system as recited in claim 6, wherein said switch comprises a bus buffer having on output terminal connected between said second resistor and said third resistor.

8. The system as recited in claim 7, wherein said first circuit further comprises a flip flop linked to said bus buffer for enabling and disabling said bus buffer.

9. The system as recited in claim 1, wherein said predetermined condition electrical signal comprises a first condition electrical signal when said triggering switch is placed in a closed position and a second condition electrical signal when said triggering switch is placed in an open position.

10. The system as recited in claim 9, wherein said predetermined condition electrical signal further comprises a third condition electrical signal when said triggering device is electrically disconnected and a fourth condition electrical signal when said triggering device is electrically connected.

11. The system as recited in claim 10, wherein said predetermined reference electrical signal comprises a normal reference electrical signal and a test reference electrical signal.

12. The system as recited in claim 11, wherein said comparing circuit compares said predetermined condition electrical signal with said normal reference electrical signal and generates a first output electrical signal if said triggering switch is in said open position and a second output electrical signal if said triggering switch is in said closed position.

13. The system as recited in claim 12, wherein said comparing circuit compares said predetermined condition electrical signal with said test reference electrical signal and generates a third output electrical signal if said triggering switch is electrically connected and a fourth output electrical signal if said triggering switch is electrically disconnected.

14. A pinball machine, comprising;

a playfield on which is mounted an electrically connected triggering switch;

an operational amplifier for generating an output signal indicative of the condition of said switch;

a first resistor connected in parallel across said triggering switch and having one terminal linked to said operational amplifier for supplying said operational amplifier with a predetermined condition voltage signal;

a second resistor linked to said operation amplifier for supplying said operation amplifier with a predetermined reference voltage signal; and means associated with said second resistor for changing predetermined reference voltage signal;

wherein said predetermined condition voltage signal comprises a first condition voltage signal when said triggering switch is placed in a closed position, a second condition voltage signal when said triggering switch is placed in an open position, a third condition voltage signal when said triggering device is electrically disconnected, and a fourth condition voltage signal when said triggering device is electrically connected;

wherein said predetermined reference electrical signal comprises a normal reference electrical signal and a test reference electrical signal;

wherein said operation amplifier generates a first output signal if said triggering switch is in said open position, a second output signal if said triggering switch is in said closed position, a third output signal if said triggering switch is electrically connected, and a fourth output signal if said triggering switch is electrically disconnected.

* * * * *